United States Patent [19]

Merl

[11] Patent Number: 4,974,734

[45] Date of Patent: Dec. 4, 1990

[54] RADIALLY EXPANDABLE SHELF DISPLAY

[75] Inventor: Milton Merl, New York, N.Y.

[73] Assignee: The Howard Marlboro Group, New York, N.Y.

[21] Appl. No.: 412,787

[22] Filed: Sep. 26, 1989

[51] Int. Cl.[5] ..... A47F 3/14

[52] U.S. Cl. ..... 211/126; 108/91; 211/133

[58] Field of Search ..... 211/126, 133, 149, 162, 211/195, 201, 151; 108/91, 93, 107

[56] References Cited

U.S. PATENT DOCUMENTS 4,008,807 2/1977 Phillips ..... 211/162 X 4,657,317 4/1987 Gemma ..... 211/162 X

*Primary Examiner*—Blair M. Johnson

*Attorney, Agent, or Firm*—Darby & Darby

[57] ABSTRACT

A radially expandable shelf display includes a plurality of stacked shelves, arrayed at a plurality of selected vertical levels and clustered about a central axis. A post extends vertically and is connected to each shelf in a vertical stack. A guide beam, fixedly attached to the post, extends radially outward from the central axis. A platform, above the layers of shelves encloses a rectangular box-like structure having an open bottom. Guide rails extend radially from the platform, the guide rails being separated by a gap wherein the guide beam is seated. In use, each post, and connected shelves, may be individually moved radially outward from the axis with the guide beam sliding between the guide rails.

7 Claims, 4 Drawing Sheets

RADIALLY EXPANDABLE SHELF DISPLAY

FIELD OF THE INVENTION

This invention relates generally to display shelving of the multi-layer type and more particularly to a radially expandable shelf display.

BACKGROUND OF THE INVENTION

As the number of articles which are on sale at the retail level continues to proliferate, floor space in department stores, food stores, hardware stores, and the like, comes at an increasingly high premium. The grant to a product manufacturer or distributor of floor and shelf space in such establishments may well depend upon the adaptability of the display shelving to fit within available space, whose area may be unpredictable in size and contour. Further, there is a trend towards displaying small items on shelving where such items have not previously been available, for example, placing displays of snacks adjacent to soft drink vending machines. The burden of supplying the displaying apparatus in many instances falls on the manufacturer or distributor of the product.

What is needed is a versatile shelf display which is readily adjustable in size to correspond with available space and the nature of the product to be displayed.

OBJECTS OF THE INVENTION

Accordingly, it is an object of this invention to provide an improved shelf display having a "footprint" which is readily adjustable in size.

Another object of this invention is to provide an improved shelf display having a "footprint" which is expandable in a symmetrical or asymmetrical pattern.

Yet another object of this invention is to provide an improved shelf display which provides a plurality of shelves at a plurality of levels, shelf spacing, one from the other, being horizontally adjustable.

In accordance with a preferred embodiment of the invention, a shelf display is provided which is especially suited for dimensional adjustments to accommodate an available space.

In accordance with a preferred embodiment of the invention, a radially expandable shelf display includes a plurality of stacked shelves which are arrayed at a plurality of selected vertical levels. Four shelves are clustered at each level about a central axis, each shelf being generally rectangular. The cluster of four shelves is also generally rectangular when each individual shelf has its inner apex positioned at the central axis. A post, extends vertically and is fixedly connected to each shelf in a vertical stack. The lowest level of shelves rests on a horizontal surface, for example, the floor, and the posts, extend upwardly from the floor level. A plate closes the top of the post and is integral therewith, giving rigidity to the post structure even when fabricated, for example, of light-weight metal, plastic or wood.

A guide beam, attached to the plate, extends radially outward from the central axis and is a rectangular vertically-oriented plate. A platform, positioned above the layers of shelves, includes a top surface, sides and ends, forming a rectangular box-like structure having an open bottom. A pair of guide rails extend substantially radially at the intersections between the platform sides and ends, the guide rails being separated by a gap which approximates the thickness of the guide beam. The platform is positioned over the stacks of shelves with the guide beams received in the gaps between the guide rails.

In use, all of the posts may be positioned such that the central shelf apexes meet at the central axis. This is the most compact condition, as illustrated in FIG. 1, and provides the smallest footprint. Each post and stack of connected shelves may be individually moved radially outward, with the guide beam sliding between the guide rails, into the fully extended position, while the remaining posts and connected shelves remain at the central axis or at any intermediate position between a fully extended condition and the centrally located position.

Further objects and advantages of the invention will be apparent from the specification and drawings. The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
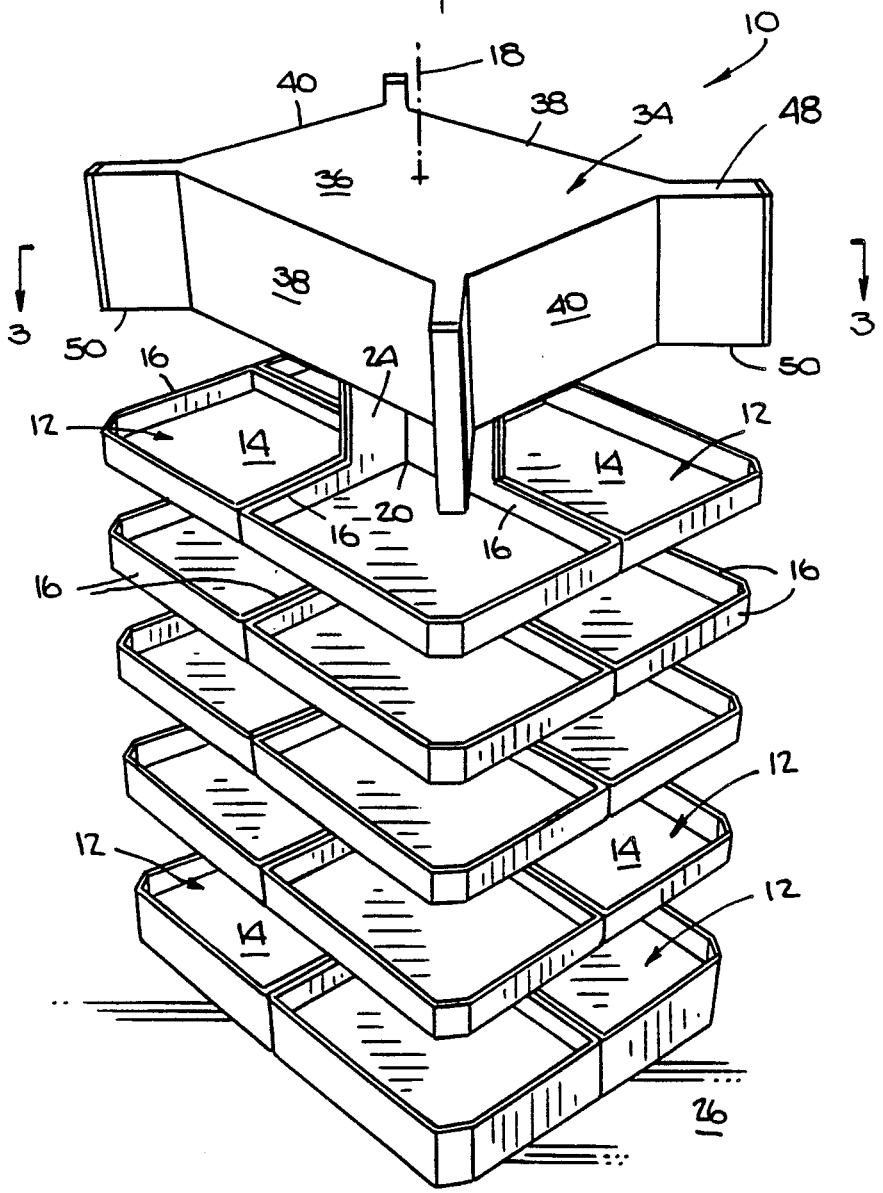
FIG. 1 is a top perspective view of a radially expandable shelf display in accordance with the invention.

With reference to the figures, a radially expandable shelf display 10 in accordance with the invention includes a plurality of shelves 12 which are arrayed at a plurality of selected levels. Four shelves 12 are substantially coplanar at each level. Each shelf 12 has a load-bearing surface 14 enclosed by a raised border 16 which prevents objects from falling from the shelf.

Four shelves 12 are clustered at each level about a central axis 18, each shelf 12 being generally rectangular. The cluster of four shelves 12 is also generally rectangular when each individual shelf 12 has its central apex 20 positioned at the central axis 18 and the central angle 22 of each shelf is 90 degrees.

It should be understood that the construction is similar in each quadrant of the shelf display 10 and a description of the construction in one quadrant is equally applicable to the similar elements around the central axis 18.

A post 24, in the form of a right angle member, extends vertically between a stack of shelves 12 and is fixedly connected to each shelf in a vertical stack. The post encloses the central angle 22 of each shelf 12, and, as illustrated, is integral with the adjacent raised borders 16. The lowest level of shelves 12 rests on a horizontal surface 26, for example, the floor, and the central posts 24, of which there are four in the illustrated embodiment, extend upwardly from the floor level. A triangular plate 28 closes the top of the post 24 and is integral therewith, giving rigidity to the post structure even when fabricated, for example, of light-weight metal, plastic or wood.

A guide beam 30 is fixedly attached to the triangular plate 28 and extends radially outward from the central axis 18, bisecting the central angle 22. The guide beam 30 is a rectangular vertically-oriented plate which has a radial length equal to the diagonal dimension measured from the apex 20 of the tray 12 along the bisector of the central angle 22. At the radially outward end of the guide beam 30 is a stop 32, which is a flat plate set at right angles to the guide beam 30 and extending beyond the lateral surfaces thereof.

A platform 34 is positioned above the layers of shelves 12. The platform 34 includes a top surface 36, a pair of sides 38 and a pair of ends 40, forming a rectangular box-like structure having an open bottom. A pair of guide rails 42 extend substantially radially at the intersections between the sides 38 and ends 40, the guide rails 42 being separated by a gap 44 which approximates the thickness of the guide beam 30. The vertical depth of the guide rails 42 approximately equals the height 46 of the guide beam 30. The guide rails 42 are parallel to each other and lie parallel to a bisector of the central shelf angle 22.

Accordingly, when the platform 34 is positioned over the stacks of shelves 12 with the top surface 36 upward, the guide beams 30 are received in the gaps 44 between the guide rails 42. The guide rails 42 are covered from the top by an extension 48 from the top surface 36 and from below by a rectangular plate 50. It should be understood that in alternative embodiments in accordance with the invention, the top surface 36 may be larger, for example, to include the extensions 48 and form a rectangular top surface, or even to extend beyond the shelves 12. It should also be understood, that for structural strength, the guide rails 42 may extend inwardly substantially to the central axis 18.

Figure 2:
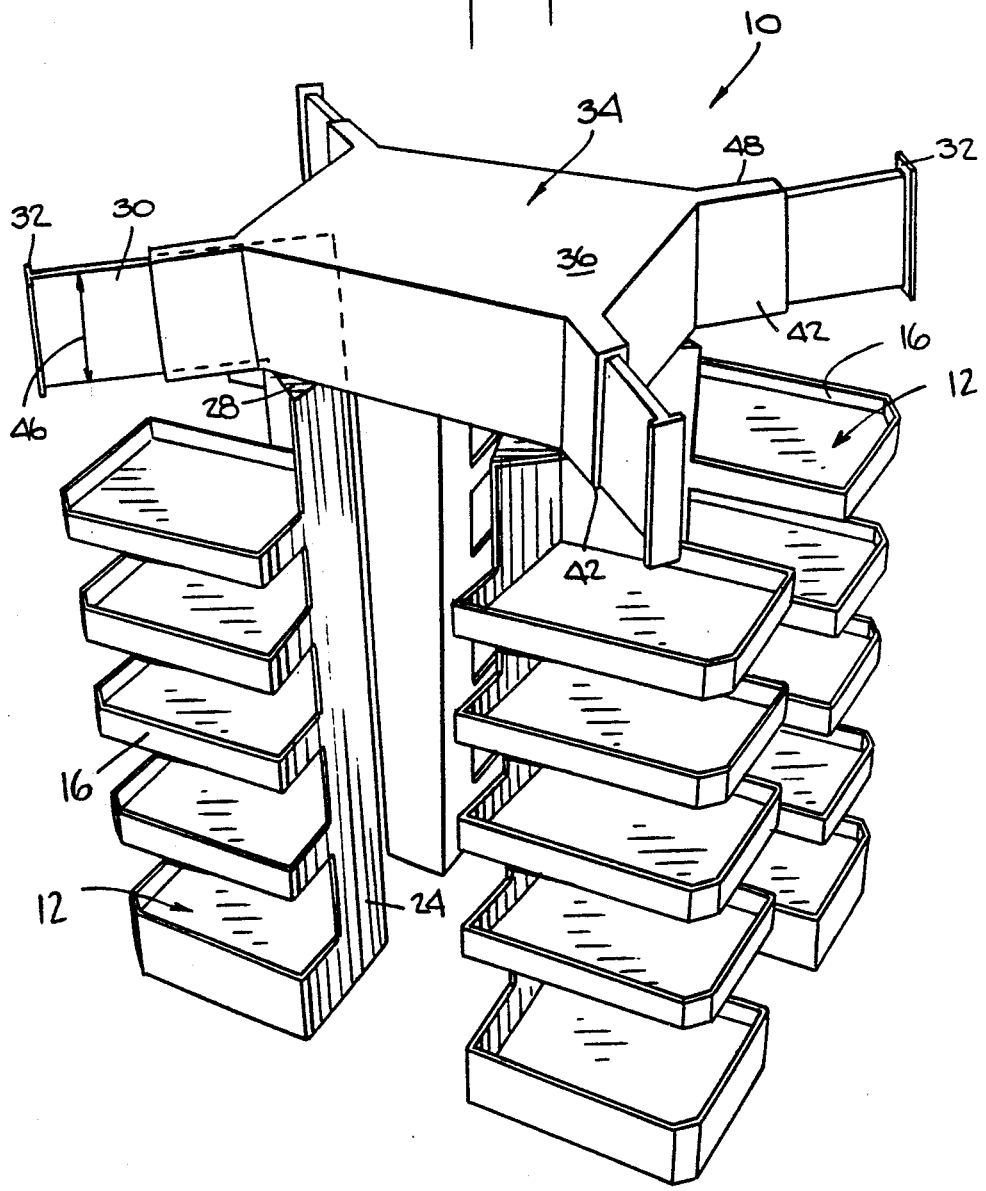
FIG. 2 is a view similar to FIG. 1 with the shelf display in the expanded state.

In use, all of the posts 24 may be positioned such that the central shelf apexes 20 meet at the central axis 18. This is the most compact condition, as illustrated in FIG. 1. The stops 32 assure that all shelves are symmetrically positioned at the axis. Each post 24 may be individually moved radially outward, with the guide beam 30 sliding between the guide rails 42. FIG. 2 illustrates the shelf display in accordance with the invention with two shelf stacks in the fully expanded condition and two shelf stacks in the compact condition. The guide beams 30 are visible in extension from between the guide rails 42.

It will be appreciated, that in use, any one, two, three or four posts 24, with the connected stacked shelves, may be moved into the extended position radially outward from the central axis 18 while the remaining posts and connected shelves remain at the central axis 18 or at any intermediate position between a fully extended condition and the centrally located position. Outward extension of the shelves is limited by contact between the triangular plate 28 and the rectangular plate 50.

Figure 3:
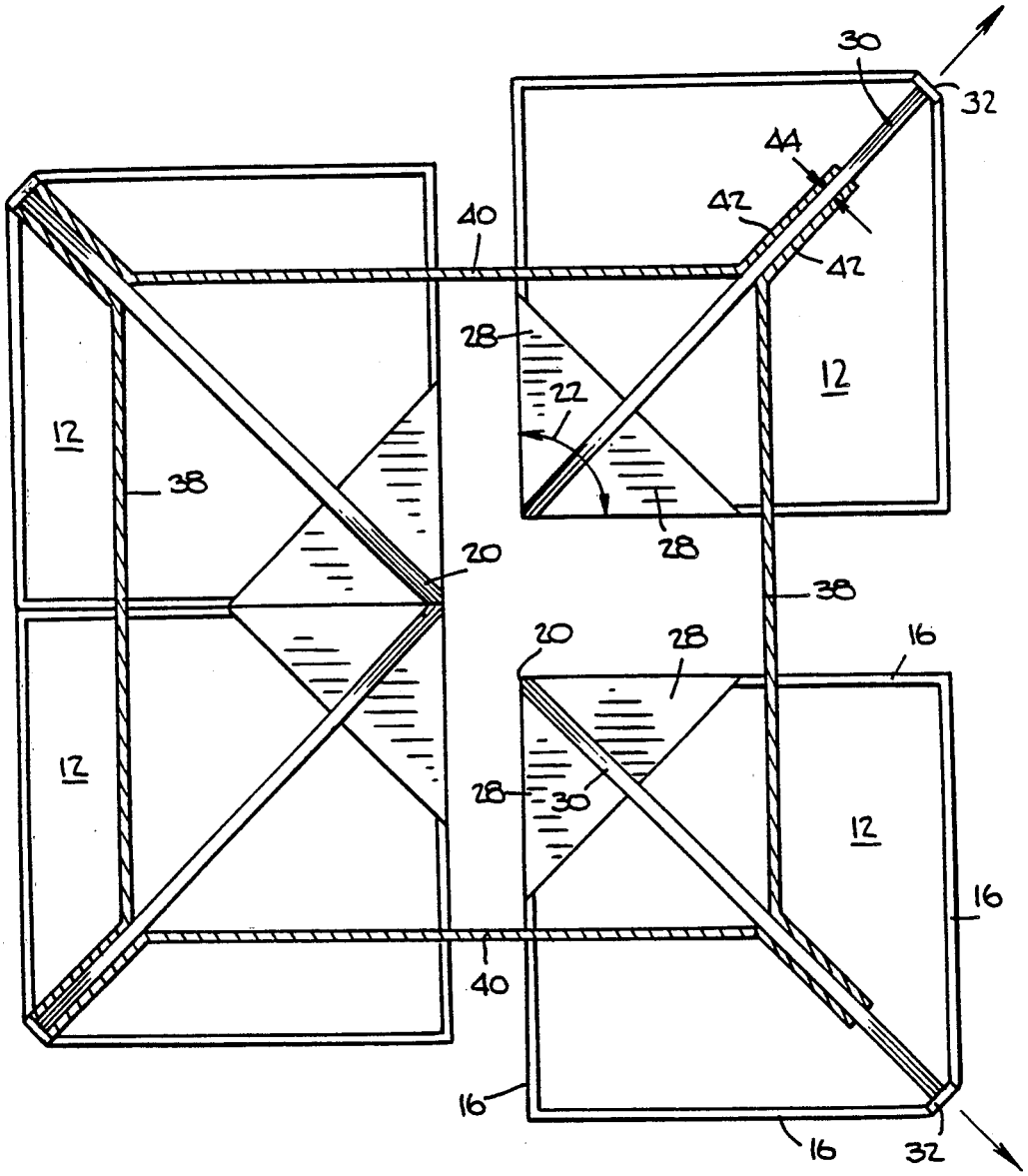
FIG. 3 is a sectional view taken along the line 3—3 of FIG. 1.
Figure 4:
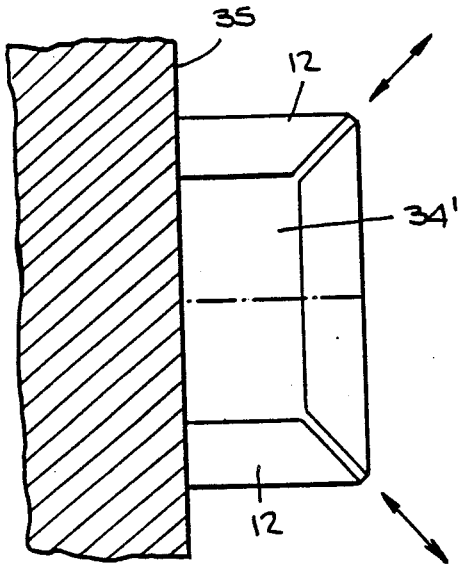
FIGS. 4 and 5 are top views of alternative embodiments of a shelf display in accordance with the invention.
Figure 5:
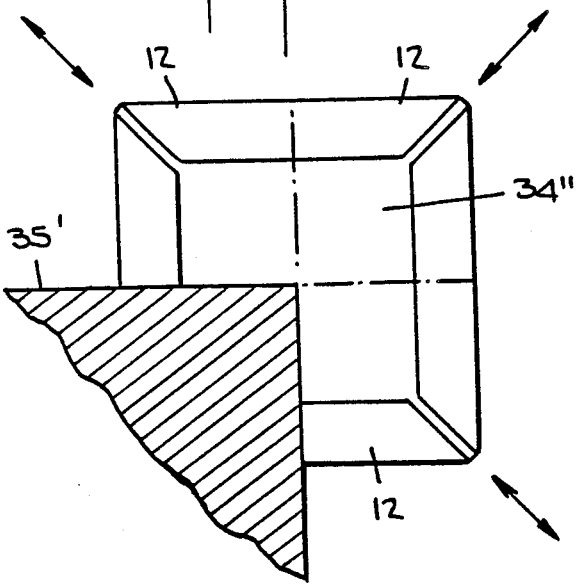

In alternative embodiments of radially expandable shelf displays 10 in accordance with the invention, the number of posts may be two (FIG. 4) and the platform 34' may be proportionately reduced in size. In such case, the platform 34' may be connected to a vertical wall 35 or other support to give the structure greater stability. Further, in another alternative embodiment (FIG. 5) there may be three posts, the platform 34'' having a right angle cut-out where a post and its connected trays are missing (as compared to FIGS. 1–3). Such a construction is especially suitable at the convex intersection of two wall surfaces 35'. The shelf display would then be "wrapped" around the corner with one stack of shelves against one wall surface, another stack against the other wall surface and the intermediate stack of shelves extending from the apex of the wall intersection.

It should also be understood that whereas in the figures and in the description above the lowermost shelves in each stack rest on a horizontal surface, for example, the floor, the entire assembly may be inverted such that the display shelf 10 stands on the platform 34 with the surface 36 against the floor. In such an alternative construction, in accordance with the invention, the tray borders 16 which extend toward the platform 34 in the illustrated embodiment may be reversed to extend away from the platform 34. Further, it should be understood that in alternative embodiments, the number of posts 24 and stacks of shelves 12 may be greater than the illustrated four, for example, there may be six segments, eight segments, etc. The number of segments need not be an even number but may also be an odd quantity. The external periphery need not be square but may be of many shapes, for example, round, polygonal, etc. The quantity of shelves 12 in a vertical stack need not be five, as illustrated, but may be more or less.

In constructions, as illustrated, where the assembly in contracted state is symmetrical about the central axis 18, the sum of the central angles 22 is 360 degrees. Where the central angle is, for example, 45 degrees, the number of posts and stacks of shelves would be eight, or may be four, leaving an empty space circumferentially between each stack of shelves. Also, in the contracted state, the platform 34 can be circular, while the shelves in combinations at a given level may form a rectangular surface, and vice versa.

In yet another alternative embodiment (not shown) in accordance with the invention, the platform 34 may be supported by an independent post which extends between the platform 34 and the horizontal surface 26. In such a construction, the posts 24 may be suspended from the guide beams 30, which ride between the guide rails 42, extension 48 and lower plate 50. That is, the stacks of shelves 12 hang from the platform 34, whereas in the illustrated embodiment (FIGS. 1–3), the platform 34 is supported by the posts 24.

It should also be understood that the shelves need not extend entirely to the central axis 18 and the posts need not be at the axis 18 in the compacted condition.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limited sense. It is also to be understood that the following claims are intended to cover all of the generic features of the invention herein described and all statements of the scope of the invention which might be said to fall therebetween.

What is claimed is:

1. An expandable shelf display comprising:

a platform having a surface arranged about a central vertical axis;

a plurality of guide rails connected to said platform and extending in parallel pairs generally radially from said axis, said guide rails in said pairs being separated by a gap;

a first plurality of horizontal shelves positioned symmetrically about said axis and away from said platform;

a plurality of vertical posts, each said post having one of said shelves connected thereto;

a plurality of guide beams, a guide beam being connected proximate one end of each said post, each said guide beam being slidably positioned in the gap between a pair of said guide rails, said posts with connected shelves being subject to sliding movement radially toward and away from said axis.

2. An expandable shelf display as claimed in claim 1, and further comprising at least one additional plurality of horizontal shelves spaced apart from said first plurality of shelves and from said platform and positioned between said first plurality of shelves and said platform, each said post having one shelf of said at least one additional plurality of shelves connected thereto.

3. An expandable shelf display as claimed in claim 2, wherein the number of said posts is four and each plurality of shelves includes four shelves, the total number of shelves being twenty.

4. An expandable shelf display as claimed in claim 1, wherein the number of said shelves is four, said shelves when slid to said axis forming, in combination, a larger surface.

5. An expandable shelf display as claimed in claim 1, and further comprising stop means for limiting the radial inward and outward positions of said posts.

6. An expandable shelf display as claimed in claim 1, wherein the bottom surface of each said shelf is adapted for resting on a horizontal surface.

7. An expandable shelf display as claimed in claim 1, wherein said posts connect to said shelves at a radially inward portion of said shelves.

* * * * *